United States Patent [19]

Guterman

[11] Patent Number: 4,609,833

[45] Date of Patent: Sep. 2, 1986

[54] SIMPLE NMOS VOLTAGE REFERENCE CIRCUIT

[75] Inventor: Daniel C. Guterman, Plano, Tex.

[73] Assignee: Thomson Components-Mostek Corporation, Carrollton, Tex.

[21] Appl. No.: 522,951

[22] Filed: Aug. 12, 1983

[51] Int. Cl.[4] ..... G05F 3/16

[52] U.S. Cl. ..... 307/297; 307/296 R; 307/304

[58] Field of Search ..... 307/296 R, 297, 304

[56] References Cited

U.S. PATENT DOCUMENTS

| | | | |
|---|---|---|---|
| 4,010,425 | 3/1977 | Dingwall et al. | 307/297 X |
| 4,052,229 | 10/1977 | Pashley | 357/23.12 X |
| 4,243,948 | 1/1981 | Schade, Jr. | 307/296 R X |
| 4,268,764 | 5/1981 | Eckert | 307/290 X |
| 4,293,782 | 10/1981 | Tanaka et al. | 307/304 X |
| 4,301,380 | 11/1981 | Thomas | 307/297 X |
| 4,346,344 | 8/1982 | Blauschild | 307/304 X |
| 4,375,596 | 3/1983 | Hoshi | 307/297 |
| 4,408,385 | 10/1983 | Mohan Rao et al. | 357/23.9 X |
| 4,451,744 | 5/1984 | Adam | 307/297 |
| 4,471,290 | 9/1984 | Yamaguchi | 307/297 X |

*Primary Examiner*—Stanley D. Miller
*Assistant Examiner*—D. R. Hudspeth
*Attorney, Agent, or Firm*—Roland Plottel

[57] ABSTRACT

A simple, compact voltage reference circuit for an NMOS integrated circuit comprises a series connected depletion transistor with its gate at ground and an enhancement transistor with its gate connected to an output node between the two transistors.

2 Claims, 3 Drawing Figures

FIG. 1 PRIOR ART
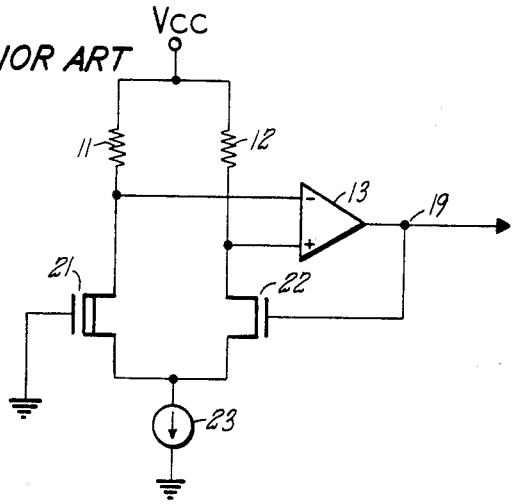
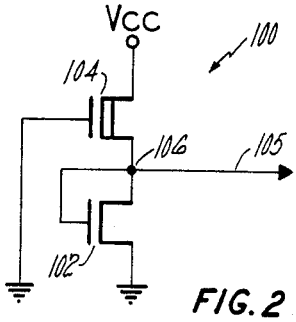
FIG. 2
FIG. 3
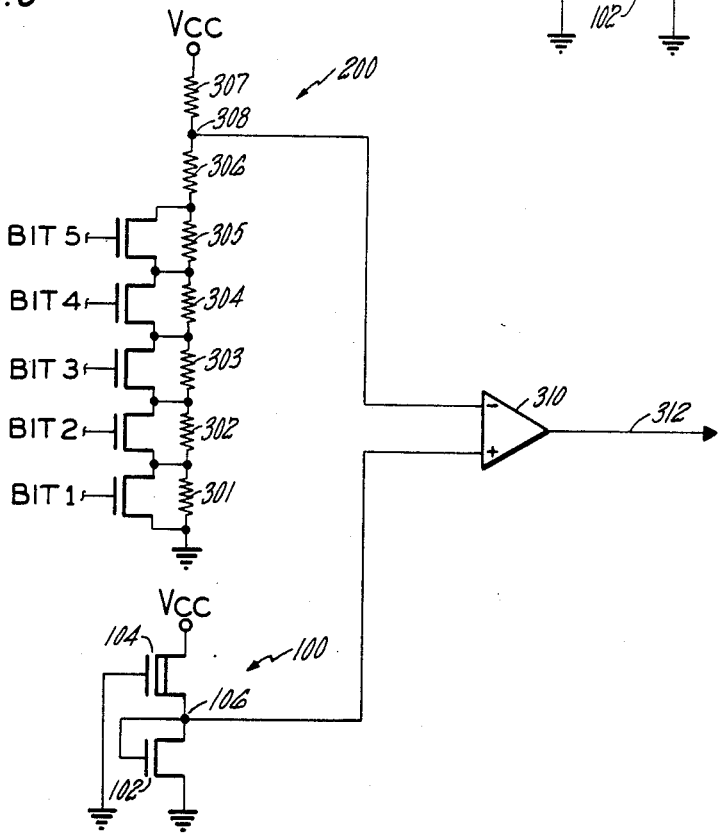

SIMPLE NMOS VOLTAGE REFERENCE CIRCUIT

DESCRIPTION

1. Technical Field

The field of the invention is that of a voltage reference circuit for integrated circuits using the NMOS process.

2. Background Art

In contrast to the CMOS process, where the band gap voltage difference is available as a voltage reference, NMOS has no such reference. If a simple voltage divider is used, the reference voltage provided will inherently depend on the fluctuations in the supply voltage.

One approach, illustrated in the 1978 IEEE International Solid State Circuits Conference Paper No. WAM 3.5 by Blauschild et al, beginning on page 50, illustrates a voltage reference circuit that depends on the voltage threshold difference between a depletion transistor and an enhancement transistor. FIG. 4 of that article discloses a temperature stable reference circuit that uses two transistors, one current sink, two resistors and an amplifier to control the output voltage. This circuit requires a considerable number of components and may consume a relatively large amount of power, both of which features are undesirable in integrated circuits.

DISCLOSURE OF INVENTION

The invention relates to a simple voltage reference circuit that uses only two series transistors, one depletion and one enhancement, to provide a voltage reference circuit that is stable with respect to both temperature and supply voltage.

A feature of the invention is that the circuit has two self-biased series connected transistors matched in size.

Another feature of the invention is that a pull-up transistor is a depletion transistor and the pull-down transistor is an enhancement transistor.

Another further feature of the invention is that the circuit reference voltage is also insensitive to substrate bias over a substantial bias range.

BRIEF DESCRIPTION OF DRAWINGS

FIG. 1 illustrates a prior art voltage reference circuit.

FIG. 2 illustrates an embodiment of the invention.

FIG. 3 illustrates a circuit using the invention.

BEST MODE FOR CARRYING OUT THE INVENTION

As can be seen in paragraph 1, the prior art voltage reference circuit uses a depletion transistor 21 connected in parallel with an enhancement transistor 22, both of them being connected to a current sink 23. The depletion and enhancement transistors are fed respectively by resistors 11 and 12, both connected to VCC. Depletion transistor 21 is turned on by having its gate connected to ground and enhancement transistor 22 is turned on by an amount controlled by the output of amplifier 13. The drains of transistor 21 and 22 will attempt to be at different voltages depending upon the degree to which the different transistors are turned on, and thus the inputs to amplifier 13 will reflect an input signal that will, in turn, produce output signal 19, the voltage reference signal.

Since the input to amplifier 13 represents the difference in voltage drop across the two transistors 21 and 22, it is necessary for the stability of this circuit that both these transistors be affected the same way by temperature variations as illustrated below.

The difference in current flowing through parallel transistors 21 and 22 as a function of temperature will result in a voltage difference to amplifier 13. The voltage difference will in turn be applied to the gate of transistor 22, tending to reduce the voltage difference to zero. Thus, for example, if transistor 22 becomes effectively more resistive as a function of temperature change, its drain rises in voltage and amplifier 13 will raise the output voltage on 19 to turn on the gate of transistor 22 more strongly and thus to drop the voltage on the drain of transistor 22. Therefore the stability of node 19 depends on how closely transistors 21 and 22 track with temperature under this bias arrangement.

The amount of area on an integrated circuit chip taken up by the circuit of FIG. 1 will depend on the configuration of current sink 23 and amplifier 13, of course, but it is evident that the amount of silicon real estate will be much greater than that required for a pair of transistors.

Referring now to FIG. 2, circuit 100 comprises solely a pair of transistors, depletion transistor 104 connected in series between VCC and node 106 and enhancement transistor 102 connected between node 106 and ground. Transistor 104 is self-biased with its gate connected to ground and transistor 102 is self-biased with its gate connected to its drain. Node 106 is the output voltage reference going out to other circuits on the chip along line 105. In contrast to the complex feedback control of the circuit of FIG. 1, this simple, compact circuit provides unexpected voltage and temperature stability.

Transistors 102 and 104 are matched in size, illustratively being 20 microns by 20 microns, and carry the same current, since line 105 draws essentially no current. The size of the transistors is not important, except that it is convenient to make the transistors sufficiently large to minimize sensitivity to variations in the geometry, short channel or narrow width effects.

This circuit is rather insensitive to fluctuations in the supply voltage, the mechanism for this insensitivity being based on the fact that the drive of the depletion pull-up transistor, with gate at ground, is dependent primarily on the pinch off voltage which, for a long L device, is relatively insensitive to the drain to source voltage. Thus, when VCC is above pinch off (e.g., greater than four volts) the drive of transistor 104 is insensitive to voltage variation. In contrast, the prior art circuit has to use a feedback loop to achieve voltage stability.

A further advantageous result is that the circuit is stable over a wide temperature range. Since the transistors are in series, it is necessary for temperature stability of the output voltage that both devices respond in the same way to temperature changes. Depletion transistors tend to be sub-surface devices in the sense that the channel is displaced below the surface, so that the electron scattering depends on the characteristics of the layer below the surface; while the enhancement transistor operates as a surface device, since the channel is effectively at the surface. Depletion devices are more complex in their behavior than enhancement devices—and are considerably more difficult to model, especially in the cutoff regime. This invention takes advantage of the fortuitous circumstance that temperature dependence of surface and sub surface mechanisms are the same.

There is a further advantage of this simple circuit—that it gives a reasonably large fraction of the supply voltage, approximately 30 per cent, and is tolerant of wide variations in the threshold voltage. As can be seen in the experimental data presented later, typical reference voltages are in the range of 1.3 to 1.6 volts.

A further advantageous feature of the invention is that it draws little power, typically in the range of 5 microamps to 50 microamps.

Table I illustrates the voltage at node 106 for a number of combinations of threshold voltage, power supply voltage and temperature.

Column A in Table I demonstrates data in which transistor 104 is formed by a depletion dose of arsenic combined with a light enhancement dose of boron and in which transistor 102 is formed by the same light enhancement dose of boron. Data was obtained with threshold voltages on the enhancement transistor ranging from 0.01 volts to 0.43 volts. Column B illustrates data taken when transistor 104 has a depletion arsenic dose plus a high dose of boron for enhancement while transistor 102 has the same high enhancement dose of boron. Enhancement transistor threshold voltages for different dosages in this column range from 0.70 to 1.14 volts. Typically the As depletion dose was $1\times10^{12}$ ions/cm$^2$ and the light and heavy enhancement doses of boron were $1\times10^{11}$ ions/cm$^2$ and $4\times10^{11}$ ions/cm$^2$, respectively.

The variation in threshold voltage reflects different implant dosages. For a given dose, the temperature and voltage dependence is shown by four measurements; at 20° C., and at 110° C. for VCC=+4 V and 6V. The starting material was a 10–15 ohm-cm p-Si <100> substrate, with a gate oxide thickness of 750 Angstroms.

Both types of transistor combinations have a combined voltage and temperature stability of 20 millivolts in about 1.5 volts, for a variation of less than one part in eighty. It can be seen from the data that the light enhancement pair is slightly more temperature stable while the high enhancement pair is more stable with respect to supply voltage. The stability of the two enhancement doses is so close that, in most cases, the same enhancement dose can be used for the voltage reference circuit as for the other transistors on the chip. It is clearly a considerable advantage that the subject circuit has this little sensitivity to dose variations.

Table II illustrates data taken at various values of substrate bias. This is a further advantageous feature of the invention, since for many circuits it is desirable to bias the substrate. For example a biased substrate is often used to reduce the junction capacitance between the source and substrate and between the drain and substrate, or to circumvent undesirable body effects of transistors.

FIG. 3 illustrates a circuit employing an application of the invention, the particular circuit shown being a flag that indicates power supply voltage failure. Such circuits are used in a nonvolatile memory to trigger the write protect and storage sequence that saves data in the event of a power failure. The circuit in FIG. 3 comprises a differential comparator 310 which has as inputs the voltage reference circuit 100 of the invention as described in FIG. 2 and a trimmable resistance divider chain circuit indicated by the numeral 200. The resistance divider chain comprises a series of resistors between VCC and ground, resistances 307 and 306 being fixed resistors and the chain formed by resistor-transistor pairs 301 to 305 being a trimming chain. In operation, the values of resistors 306 and 307 and the trimming value will be set such that the voltage at node 308 is higher than the voltage at node 106, producing a predetermined voltage level on output node 312. When the power supply fails initially, transistor 104 will still be on, since it is biased by ground and the voltage on node 106 will remain constant. The voltage on node 308 will fall, governed by VCC's fall and the resistance divider chain so the voltage on node 308 will fall below that of reference voltage node 106. The inputs to comparator 310 will then change state resulting in the voltage on line 312 changing state, giving the signal to start the data protection and storage sequence.

TABLE I

| | VBB = 0 | | | |
|---|---|---|---|---|
| | A Low Enhancement Temperature | | B High Enhancement Temperature | |
| | 20° C. | 110° C. | 20° C. | 110° C. |
| VCC = 4 V | 1.484 | 1.492 | 1.306 | 1.298 |
| VCC = 6 V | 1.492 | 1.500 | 1.308 | 1.300 |
| I(μA) | 31 | 22.5 | 3.2 | 3.4 |
| Vt | .01 | −3.40 | .70 | −2.15 |
| VCC = 4 V | 1.015 | 1.022 | 1.439 | 1.429 |
| Vcc = 6 V | 1.019 | 1.027 | 1.442 | 1.433 |
| I(μA) | 12.4 | 9.7 | 5.7 | 5.2 |
| Vt | .15 | −2.21 | .80 | −2.24 |
| VCC = 4 V | 1.584 | 1.587 | 1.246 | 1.226 |
| VCC = 6 V | 1.593 | 1.597 | 1.248 | 1.225 |
| I(μA) | 30.5 | 21.5 | 1.2 | 1.6 |
| Vt | .28 | −3.29 | .92 | −1.62 |
| VCC = 4 V | 1.534 | 1.540 | 1.322 | 1.298 |
| VCC = 6 V | 1.540 | 1.548 | 1.324 | 1.299 |
| I(μA) | 20 | 14.9 | .60 | 1.0 |
| Vt | .43 | −3.11 | 1.14 | −1.71 |

TABLE II

| | VCC = 5 V T = 20° C. | |
|---|---|---|
| VBB | V out Threshold Enh .32 V Depl −3.15 V | V out Threshold Enh .90 V Depl −1.97 V |
| 0 | 1.527 | 1.333 |
| −.5 | 1.537 | 1.388 |
| −1.0 | 1.542 | 1.415 |
| −1.5 | 1.545 | 1.431 |
| −2.0 | 1.546 | 1.440 |
| −2.5 | 1.547 | 1.447 |
| −3.0 | 1.546 | 1.450 |
| −3.5 | 1.546 | 1.451 |
| −4.0 | 1.545 | 1.451 |
| −4.5 | 1.544 | 1.450 |
| −5.0 | 1.543 | 1.445 |
| −5.5 | 1.542 | unreliable |
| −6.0 | 1.541 | unreliable |

I claim:

1. A voltage reference circuit for an NMOS integrated circuit comprising:

a semiconductor substrate;

a self-based enhancement transistor, formed in said substrate, and connected between ground and an output node, having and enhancement gate, with an enhancement gate width and enhancement gate length, connected to said output node; and a self-biased depletion transistor, formed in said substrate, and connected between said output node and a supply voltage terminal, having a depletion gate, with a depletion gate width and a depletion gate length, connected to ground;

said enhancement transistor and said depletion transistor are substantially matched in size, whereby the ratio of a width to length ratio of said enhancement transistor and a width to length ratio of said depletion transistor is one.

2. A voltage reference circuit according to claim 1, in which said depletion transistor is formed by a depletion dose of substantially $1\times10^{12}$ ions/cm$^2$ together with an enhancement dose of between 1 and $4\times10^{11}$/cm$^2$ and said enhancement transistor is formed by said enhancement dose.

* * * * *